US008316816B2

(12) United States Patent
Sato

(10) Patent No.: US 8,316,816 B2
(45) Date of Patent: Nov. 27, 2012

(54) INTERNAL COMBUSTION ENGINE AND VEHICLE HAVING THE INTERNAL COMBUSTION ENGINE

(75) Inventor: Shintaro Sato, Shizuoka (JP)

(73) Assignee: Yamaha Hatsudoki Kaisha, Shizuoka (JP)

( * ) Notice: Subject to any disclaimer, the term of this patent is extended or adjusted under 35 U.S.C. 154(b) by 1298 days.

(21) Appl. No.: 12/044,800

(22) Filed: Mar. 7, 2008

(65) Prior Publication Data

US 2008/0223662 A1 Sep. 18, 2008

(30) Foreign Application Priority Data

Mar. 13, 2007 (JP) ..... 2007-063061

(51) Int. Cl.
*F01M 1/02* (2006.01)

(52) U.S. Cl. ..... 123/196 R; 123/196 CP

(58) Field of Classification Search ..... 123/196 R, 123/193.5, 41.1, 41.86, 41.33
See application file for complete search history.

(56) References Cited

U.S. PATENT DOCUMENTS 4,920,825 A * 5/1990 Okazaki et al. ..... 74/606 R
4,960,081 A * 10/1990 Atsuumi ..... 123/41.31
4,976,668 A * 12/1990 Ashikawa et al. ..... 475/221
5,046,578 A * 9/1991 Nakayama et al. ..... 180/291
5,107,802 A * 4/1992 Yagi et al. ..... 123/90.15
5,339,918 A * 8/1994 Nakayama et al. ..... 180/292
6,279,554 B1 * 8/2001 Sayama et al. ..... 123/572
2002/0185093 A1 * 12/2002 Immel et al. ..... 123/90.31
2003/0051679 A1 * 3/2003 Iwata et al. ..... 123/41.31
2004/0065287 A1 * 4/2004 Ibukuro et al. ..... 123/179.25
2005/0193974 A1 * 9/2005 Terada et al. ..... 123/196 R
2006/0254544 A1 * 11/2006 Mizorogi et al. ..... 123/90.16
2007/0221146 A1 * 9/2007 Ashida ..... 123/41.1
2007/0227509 A1 * 10/2007 Ueda et al. ..... 123/509
2007/0272194 A1 * 11/2007 Hoi et al. ..... 123/196 R
2008/0178829 A1 * 7/2008 Ochiai et al. ..... 123/90.27
2008/0184956 A1 * 8/2008 Inui et al. ..... 123/193.5
2008/0314687 A1 * 12/2008 Shiozaki et al. ..... 184/6.5

FOREIGN PATENT DOCUMENTS

JP 2002-061516 2/2002

* cited by examiner

*Primary Examiner* — Noah Kamen
*Assistant Examiner* — Long T Tran
(74) *Attorney, Agent, or Firm* — Keating & Bennett, LLP

(57) ABSTRACT

An engine (internal combustion engine), in accordance with an embodiment, includes: a crankcase having an oil pan; a crankshaft disposed inside the crankcase; a second crank gear disposed inside the crankcase to rotate about the crankshaft; a driven gear meshed with the second crank gear to be rotated as the second crank gear rotates; an oil pump drive gear meshed with the driven gear to rotate together with the driven gear; and an oil pump gear to be rotated as the oil pump drive gear rotates. The oil pump gear is disposed to overlap the driven gear as viewed from an axial end of the crankshaft.

20 Claims, 8 Drawing Sheets

INTERNAL COMBUSTION ENGINE AND VEHICLE HAVING THE INTERNAL COMBUSTION ENGINE

CROSS-REFERENCE TO RELATED APPLICATIONS

This application is related to and claims priority to Japanese Patent Application No. 2007-063061, filed on Mar. 13, 2007, the entire contents of which is incorporated herein by reference in its entirety.

TECHNICAL FIELD

The present invention relates generally to an internal combustion engine and a vehicle including the internal combustion engine, and more specifically to an internal combustion engine including an oil pan and a vehicle including the internal combustion engine.

BACKGROUND

Conventionally, motorcycle engines (internal combustion engines) having an oil pan are known. For example, Japanese Patent Document JP-B-3411894 discloses a motorcycle engine including: an output gear that rotates together with a crankshaft; a clutch gear (speed reduction gear) meshed with the output gear to be rotated as the output gear rotates; and a pump gear meshed with the clutch gear in the vicinity of the lowermost end of the clutch gear to rotate as the clutch gear rotates.

In the above example where the motorcycle engine (internal combustion engine) has an oil pan for reserving oil, however, the pump gear may disadvantageously contact the oil and agitate the oil, because the pump gear is meshed with the clutch gear (speed reduction gear) in the vicinity of the lowermost end of the clutch gear. In this case, a part of the rotation force of the pump gear is used to agitate the oil resulting in a loss of the driving force of the motorcycle engine.

SUMMARY

The present invention, in accordance with one or more embodiments, addresses the foregoing problem, and therefore for an embodiment provides an internal combustion engine that can reduce a loss of driving force and a vehicle including the internal combustion engine.

In accordance with an embodiment, a first aspect of the present invention is directed to an internal combustion engine including: a crankcase having an oil pan; a crankshaft disposed inside the crankcase; an output gear disposed inside the crankcase to rotate about the crankshaft; a speed reduction gear meshed with the output gear to be rotated as the output gear rotates; a first gear engaged with the speed reduction gear to rotate together with the speed reduction gear; and a second gear to be rotated as the first gear rotates, in which the second gear is disposed to overlap the speed reduction gear as viewed from an axial end of the crankshaft.

According to the internal combustion engine of the first aspect in accordance with an embodiment, the second gear is disposed to overlap the speed reduction gear as viewed from an axial end of the crankshaft as described above, and thus can be disposed in the higher area by the amount of vertical overlap between the second gear and the speed reduction gear. This restrains the second gear from being disposed in the lower area of the internal combustion engine as viewed from an axial end of the crankshaft, and it is therefore possible to restrain (and possibly prevent) the second gear from contacting the oil reserved in the oil pan and agitating the oil. As a result, it is possible to restrain a part of the rotation force of the second gear from being used to agitate the oil, and thus to restrain (i.e., reduce) a loss of the driving force of the internal combustion engine.

In the internal combustion engine according to the first aspect, in accordance with an embodiment, an outside diameter of the first gear is configured to be smaller than that of the speed reduction gear. According to this configuration, since the first gear which has an outside diameter smaller than that of the speed reduction gear can be used to transmit the rotational speed equal to that of the speed reduction gear to the second gear, the outside diameter of the second gear can be reduced compared to the case where the second gear is directly meshed with the speed reduction gear to be rotated. Since this allows the lower end of the second gear to be disposed higher, it is possible to further restrain the second gear from contacting the oil reserved in the oil pan and agitating the oil.

In the internal combustion engine according to the first aspect, in accordance with an embodiment, the first gear is configured such that a first rotational speed of the first gear is lower than a second rotational speed of the output gear, and that the second gear is configured such that a third rotational speed of the second gear is higher than the first rotational speed of the first gear and lower than the second rotational speed of the output gear. According to this configuration, the second gear can be easily rotated at an appropriate rotational speed.

The internal combustion engine according to the first aspect, in accordance with an embodiment, further includes an intermediate gear disposed between the first gear and the second gear to be rotated as the first gear rotates and to rotate the second gear. According to this configuration, the driving force of the first gear can be transmitted to the second gear via the intermediate gear with the second gear disposed at a desired position.

In the internal combustion engine including the intermediate gear for rotating the second gear, in accordance with an embodiment, the intermediate gear is disposed to overlap the speed reduction gear as viewed from an axial end of the crankshaft. According to this configuration, the intermediate gear can be disposed in the higher area by the amount of vertical overlap between the intermediate gear and the speed reduction gear. This restrains the intermediate gear from being disposed in the lower area of the internal combustion engine as viewed from an axial end of the crankshaft, and it is therefore possible to restrain the intermediate gear from contacting the oil reserved in the oil pan and agitating the oil.

In the internal combustion engine including the intermediate gear for rotating the second gear, in accordance with an embodiment, the first gear, the intermediate gear, and the second gear are each made, for example, of resin. According to this configuration, the weights of the first gear, the intermediate gear, and the second gear can be each reduced compared to the case where they are each made, for example, of metal.

In the internal combustion engine according to the first aspect, in accordance with an embodiment, the second gear is disposed higher than an oil surface of oil reserved in the oil pan. According to this configuration, it is possible to securely restrain the second gear from contacting the oil reserved in the oil pan, and thus to securely restrain a loss of the driving force of the internal combustion engine.

The internal combustion engine according to the first aspect, in accordance with an embodiment, further includes an oil pump part, the second gear includes an oil pump gear attached to the oil pump part, and the first gear includes an oil pump drive gear for rotating the oil pump gear. According to this configuration, it is possible to easily and securely restrain a loss of the driving force of the internal combustion engine.

In this case, in accordance with an embodiment, the oil pump part further includes an oil pump gear shaft that rotates together with the oil pump gear, and the oil pump gear shaft is disposed higher than a lower end of the speed reduction gear. This configuration further restrains the oil pump gear from being disposed in the lower area of the internal combustion engine as viewed from an axial end of the crankshaft, and it is therefore possible to further restrain the oil pump gear from contacting the oil reserved in the crankcase and agitating the oil.

In the internal combustion engine according to the first aspect, in accordance with an embodiment, the crankcase further includes a wall disposed above the oil pan to restrain oil reserved in the oil pan from splashing. This configuration makes it possible to restrain the oil surface of the oil reserved in the oil pan from varying, eliminating the need to increase the amount of oil to be reserved inside the crankcase in order to ensure that a certain amount of oil or more is reserved in the oil pan. Consequently, the weight of the internal combustion engine can be reduced.

In this case, in accordance with an embodiment, the wall has an opening, and is formed to be inclined downward toward the opening. This configuration allows oil above the wall to flow along the wall toward the opening and then into the oil pan, enabling the oil to quickly return into the oil pan. Consequently, it is not necessary to further increase the amount of oil to be reserved inside the crankcase in order to ensure that a certain amount of oil or more is reserved in the oil pan, allowing to further reduce the weight of the internal combustion engine.

In the internal combustion engine according to the first aspect, in accordance with an embodiment, the crankcase further includes an oil guide disposed below the crankshaft to guide oil having flowed out from the crankshaft to the oil pan. According to this configuration, the oil guide can allow the oil to quickly return into the oil pan, eliminating the need to increase the amount of oil to be reserved inside the crankcase in order to ensure that a certain amount of oil or more is reserved in the oil pan. Consequently, the weight of the internal combustion engine can be reduced.

In this case, in accordance with an embodiment, the oil guide has a discharge port for guiding the oil having flowed out from the crankshaft to the opening of the oil pan. According to this configuration, the oil having flowed out from the crankshaft can be easily guided to the opening to quickly return into the oil pan.

A second aspect, in accordance with an embodiment of the present invention, is directed to a vehicle including the internal combustion engine with any one of the configurations described above. According to this configuration, it is possible to easily obtain a vehicle provided with an internal combustion engine that can restrict (or reduce) a loss of driving power.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

Figure 1:
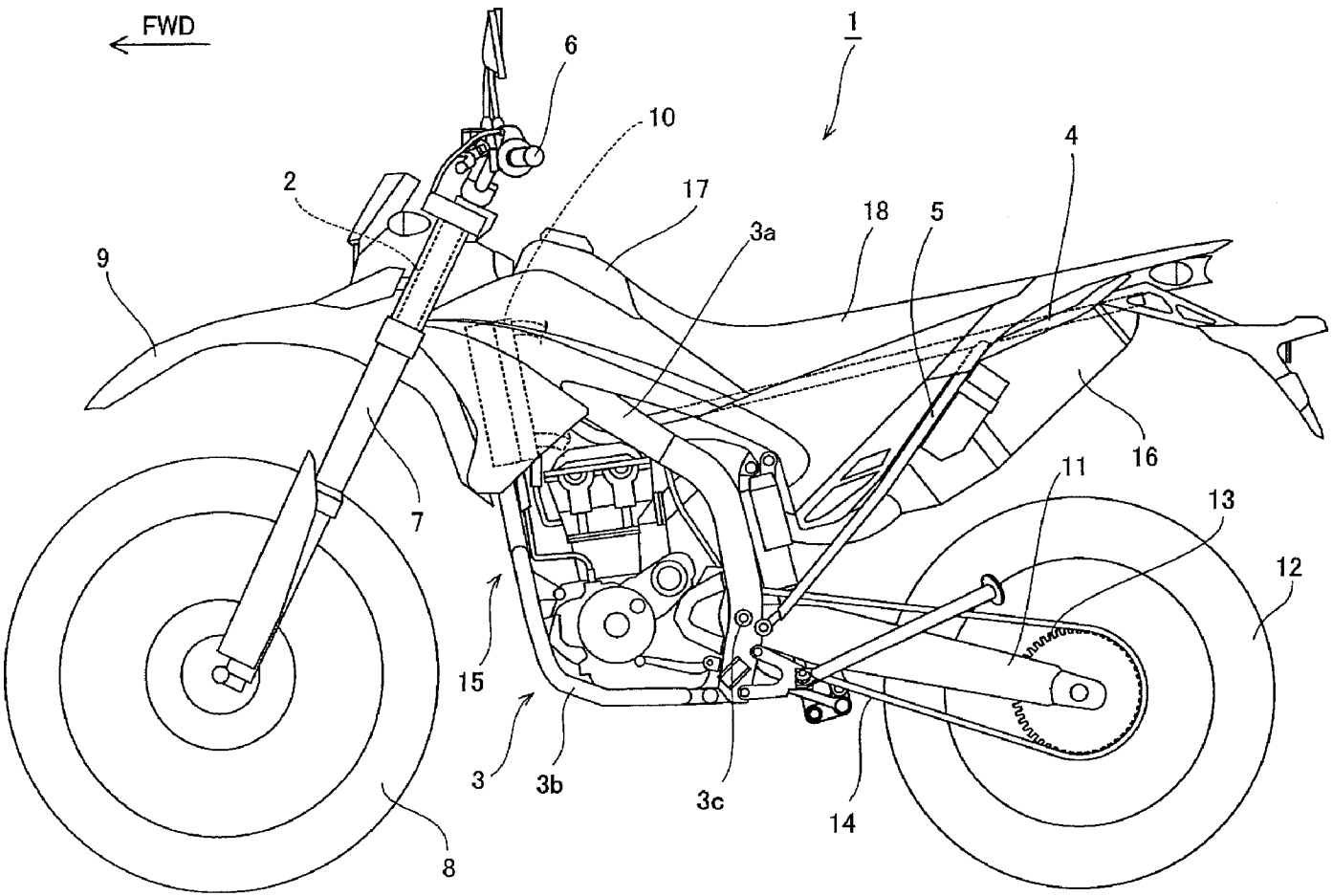
FIG. 1 is a side view showing the entire structure of a motorcycle provided with an engine in accordance with an embodiment of the present invention.

The description of various reference numerals and symbols in the drawings may be set forth in accordance with one or more embodiments, for example, as follows: 1: motorcycle, 15: engine (internal combustion engine), 22: crankcase, 22*a*: oil pan, 22*b*: wall, 22*c*: opening, 22*d*: oil guide, 22*e*: discharge port, 31: crankshaft, 33: second crank gear (output gear), 37: driven gear (speed reduction gear), 37*a*: lower end, 38: oil pump drive gear (first gear), 55: intermediate gear, 57: oil pump gear (second gear), 58: oil pump gear shaft, 59: oil pump part, and F1: oil surface.

Embodiments of the present invention and their advantages are best understood by referring to the detailed description that follows. It should be appreciated that like reference numerals are used to identify like elements illustrated in one or more of the figures.

DETAILED DESCRIPTION

FIG. 1 is a side view showing the entire structure of a motorcycle (vehicle) provided with an engine (internal combustion engine) in accordance with an embodiment of the present invention. FIGS. 2 to 8 illustrate in detail, in accordance with one or more embodiments, the structure of the engine in accordance with the embodiment shown in FIG. 1. In this embodiment, a motorcycle is described as an example of a vehicle for an embodiment of the present invention. In the drawings, the arrow FWD indicates the forward running direction of the motorcycle. First, an engine 15 in accordance with this embodiment and a motorcycle 1 provided with the engine 15 are described with reference to FIGS. 1 to 8.

In the motorcycle 1 provided with the engine (internal combustion engine) 15 in accordance with the embodiment of the present invention, as shown in FIG. 1, a main frame 3 extending longitudinally is disposed at the rear of a head pipe 2. The main frame 3 has an upper frame 3*a* extending rearward from above and a lower frame 3*b* extending downward and then rearward. A backstay 5 is connected between the upper frame 3*a* and the rear part of a seat rail 4. The head pipe 2, the main frame 3, the seat rail 4, and the backstay 5 constitute a vehicle body frame.

Handlebars 6 are rotatably attached to the top of the head pipe 2. A pair of front forks 7 having a suspension for absorbing vertical shock is disposed below the handlebars 6. A front wheel 8 is rotatably mounted at the lower end of the front forks 7. A front fender 9 is disposed above the front wheel 8. A radiator 10 is disposed at the rear of the front fork 7.

The front end of a swing arm 11 is attached to the rear end of the main frame 3 via a pivot shaft 3*c*. A rear wheel 12 is rotatably mounted at the rear end of the swing arm 11. A driven sprocket 13 is attached to the rear wheel 12 so as to rotate together with the rear wheel 12. A drive chain 14 is meshed with the driven sprocket 13. The drive chain 14 is configured to be driven by a drive sprocket 47 (see FIG. 3) of the engine 15 to be discussed later. The engine 15 is mounted as interposed between the upper frame 3*a* and the lower frame 3*b* of the main frame 3. The engine 15 is an example of the "internal combustion engine" in accordance with an embodiment of the present invention. A muffler 16 is connected to the engine 15. A fuel tank 17 is disposed on top of the main frame 3. A seat 18 is disposed on top of the seat rail 4.

Figure 2:
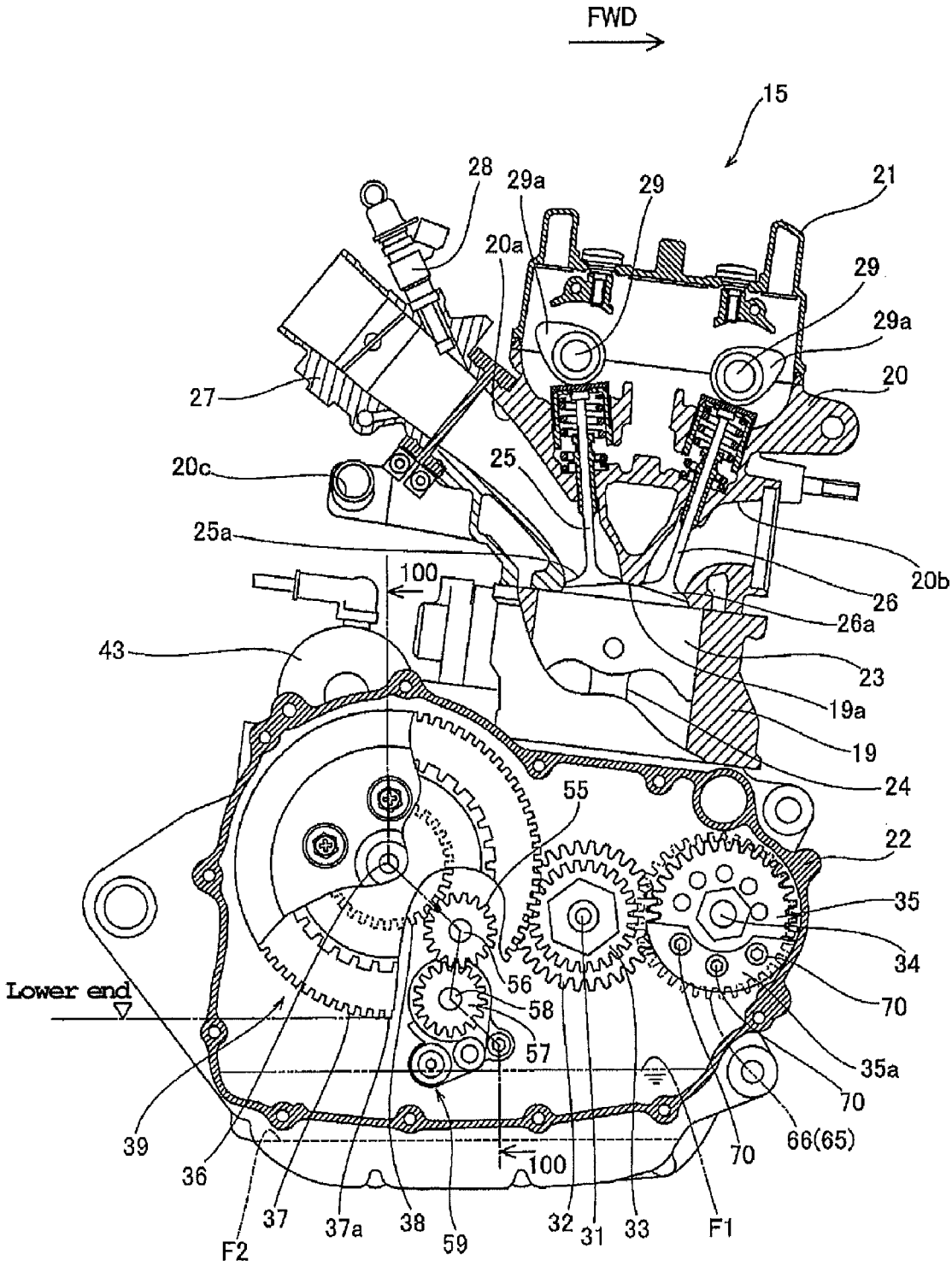
FIG. 2 is a cross sectional view of the engine provided in the motorcycle in accordance with the embodiment shown in FIG. 1.

As shown in FIG. 2, the engine 15 in accordance with an embodiment includes a cylinder 19, a cylinder head 20, a cylinder cover 21, and a crankcase 22. A piston 23 is disposed in the cylinder 19 so as to be slidable along its inner peripheral surface. One end of a connecting rod 24 is rotatably attached to the piston 23. The cylinder head 20 is disposed to block an opening of the cylinder 19. The cylinder head 20 is formed with an intake port 20*a* and an exhaust port 20*b*. An intake valve 25, made of titanium for example, and an exhaust valve 26, made of steel for example, are disposed in the intake port 20*a* and the exhaust port 20*b*, respectively. The area of an umbrella part 25*a* of the intake valve 25 is larger than that of an umbrella part 26*a* of the exhaust valve 26. A throttle body 27 is connected to the intake port 20*a*. An injector 28 for injecting fuel into the intake port 20*a* is attached to the throttle body 27. The intake port 20*a* is provided to supply a mixture of air and fuel to a combustion chamber 19*a* of the cylinder 19. The exhaust port 20*b* is provided to exhaust a residual gas after combustion from the combustion chamber 19*a*. The muffler 16 (see FIG. 1) is connected to the exhaust port 20*b* via an exhaust pipe (not shown). A drain port 20*c* is formed in the rear of the cylinder head 20. The drain port 20*c* returns coolant warmed by the engine 15 to the radiator 10 (see FIG. 1) via a hose (not shown).

Figure 3:
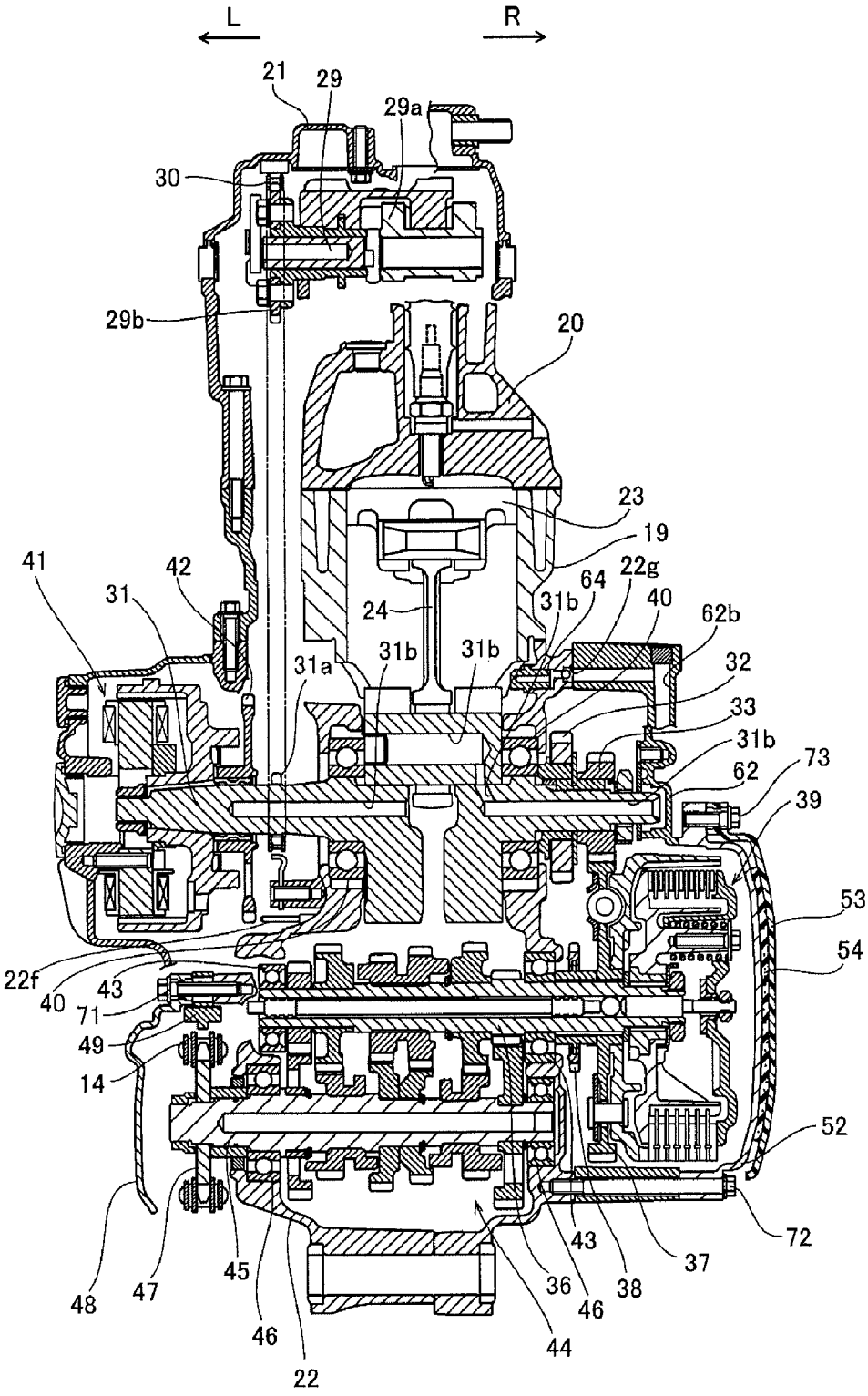
FIG. 3 is a cross sectional view of the engine provided in the motorcycle in accordance with the embodiment shown in FIG. 1.

The cylinder cover 21 is disposed on top of the cylinder head 20. The cylinder cover 21 is attached to the cylinder head 20 so as to cover a pair of camshafts 29. The camshafts 29 are each provided with a cam 29*a* for actuating the intake valve 25 and the exhaust valve 26, respectively. As shown in FIG. 3, a cam chain 30 is meshed with a gear 29*b* of the camshaft 29. The cam chain 30 is meshed with a gear 31*a* of a crankshaft 31 to be discussed later. The camshafts 29 are configured to rotate as the crankshaft 31 rotates.

Figure 4:
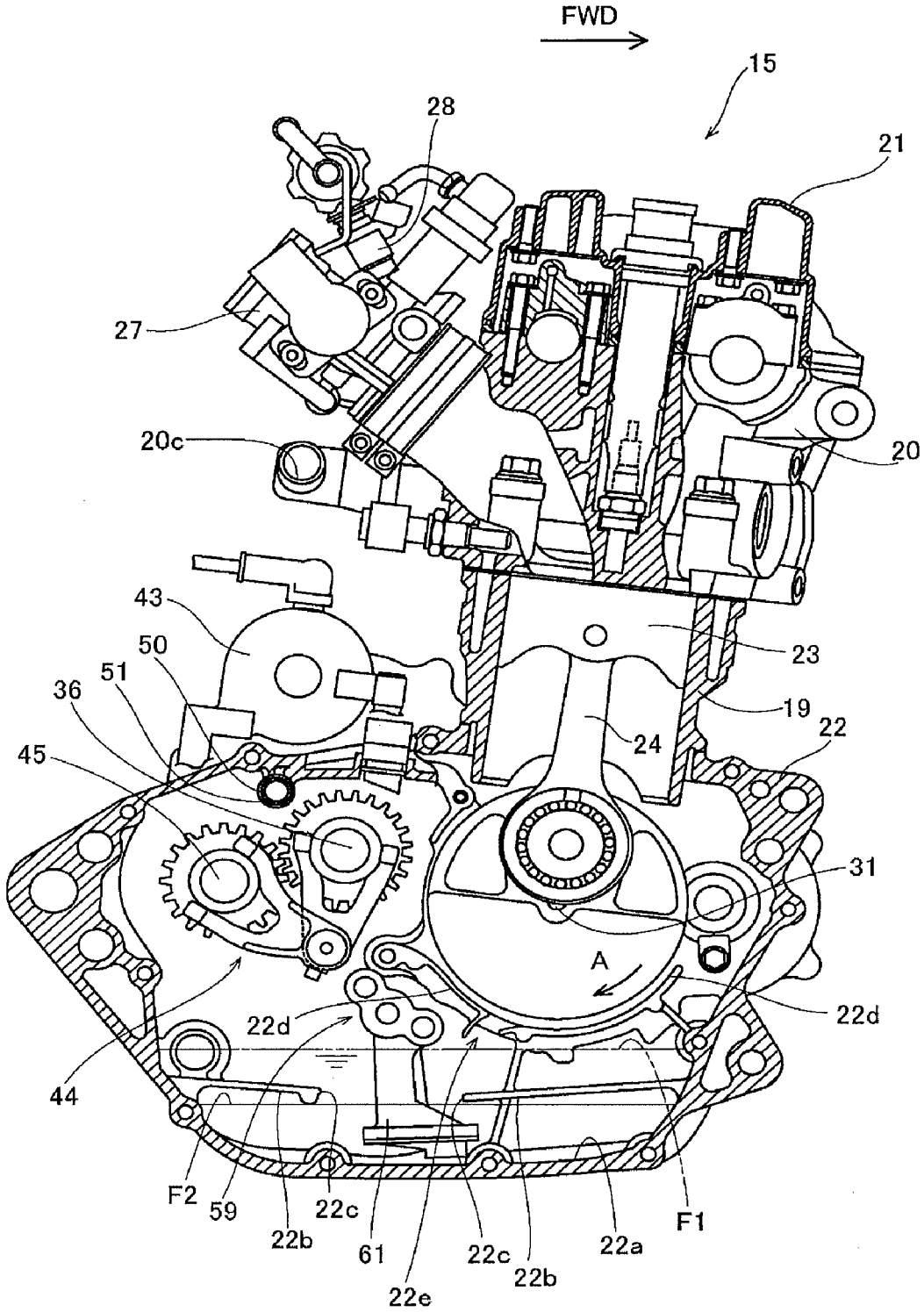
FIG. 4 is a cross sectional view of the engine provided in the motorcycle in accordance with the embodiment shown in FIG. 1.

As shown in FIG. 2, the crankcase 22 is attached to the bottom of the cylinder 19. As shown in FIG. 4, an oil pan 22*a* is provided at the bottom of the crankcase 22. The oil pan 22*a* reserves oil for lubricating the inside of the engine 15. When the engine 15 is not in operation, the oil for lubricating the inside of the engine 15 is reserved inside the crankcase 22 with the oil surface at the height F1, as shown in FIGS. 2 and 4.

In accordance with an embodiment, as shown in FIG. 4, a wall 22*b* is provided in the crankcase 22 above the oil pan 22*a*. The wall 22*b* restrains the oil reserved in the oil pan 22*a* from splashing. This makes it possible to restrain the oil surface of the oil reserved in the oil pan 22*a* from varying from the height F2, eliminating the need to increase the amount of oil to be reserved inside the crankcase 22 in order to ensure that a certain amount of oil or more is reserved in the oil pan 22*a*. Consequently, the weight of the engine 15 can be reduced. When the engine 15 is in operation, a predetermined amount of oil flows to various parts of the engine 15, and therefore the oil surface of oil reserved inside the crankcase 22 is lowered to the height F2 slightly lower than the wall 22*b*.

In accordance with an embodiment, the wall 22*b* is formed with an opening 22*c*, and formed to be inclined downward toward the opening 22*c*. This allows oil above the wall 22*b* to flow along the wall 22*b* toward the opening 22*c* and then into the oil pan 22*a*, enabling the oil to quickly return into the oil pan 22*a*. Consequently, it is not necessary to further increase the amount of oil to be reserved inside the crankcase 22 in order to ensure that a certain amount of oil or more is reserved in the oil pan 22*a*, allowing to further reduce the weight of the engine 15.

As shown in FIG. 2, inside the crankcase 22 are disposed: a crankshaft 31; a first crank gear 32 and a second crank gear 33 that rotate about the crankshaft 31; a balancer shaft 34; a balancer gear 35 that rotates about the balancer shaft 34; a main shaft 36; a driven gear 37 that rotates about the main shaft 36; an oil pump drive gear 38 attached to the driven gear 37 to rotate together with the driven gear 37; and a clutch mechanism 39 attached to the main shaft 36. The second crank gear 33 is an example of the "output gear" in accordance with an embodiment of the present invention, and the driven gear 37 is an example of the "speed reduction gear" in accordance with an embodiment of the present invention. In addition, the oil pump drive gear 38 is an example of the "first gear" in accordance with an embodiment of the present invention.

As shown in FIG. 3, the other end of the connecting rod 24 is rotatably attached to the crankshaft 31. In other words, the crankshaft 31 is configured to rotate as the piston 23 slides relative to the cylinder 19. The crankshaft 31 is disposed in the crankcase 22 so as to be perpendicular to the traveling direction of the vehicle (the direction of the arrow FWD) (see FIGS. 1 and 2). The crankshaft 31 is rotatably supported by a pair of bearings 40 mounted in the crankcase 22. The second crank gear 33 is fixed to the crankshaft 31 in the vicinity of one end thereof (in the direction of the arrow R), and configured to rotate together with the crankshaft 31. The first crank gear 32 is fixed to the crankshaft 31 adjacent to the second crank gear 33 in the direction of the arrow L, and configured to rotate together with the crankshaft 31.

Figure 5:
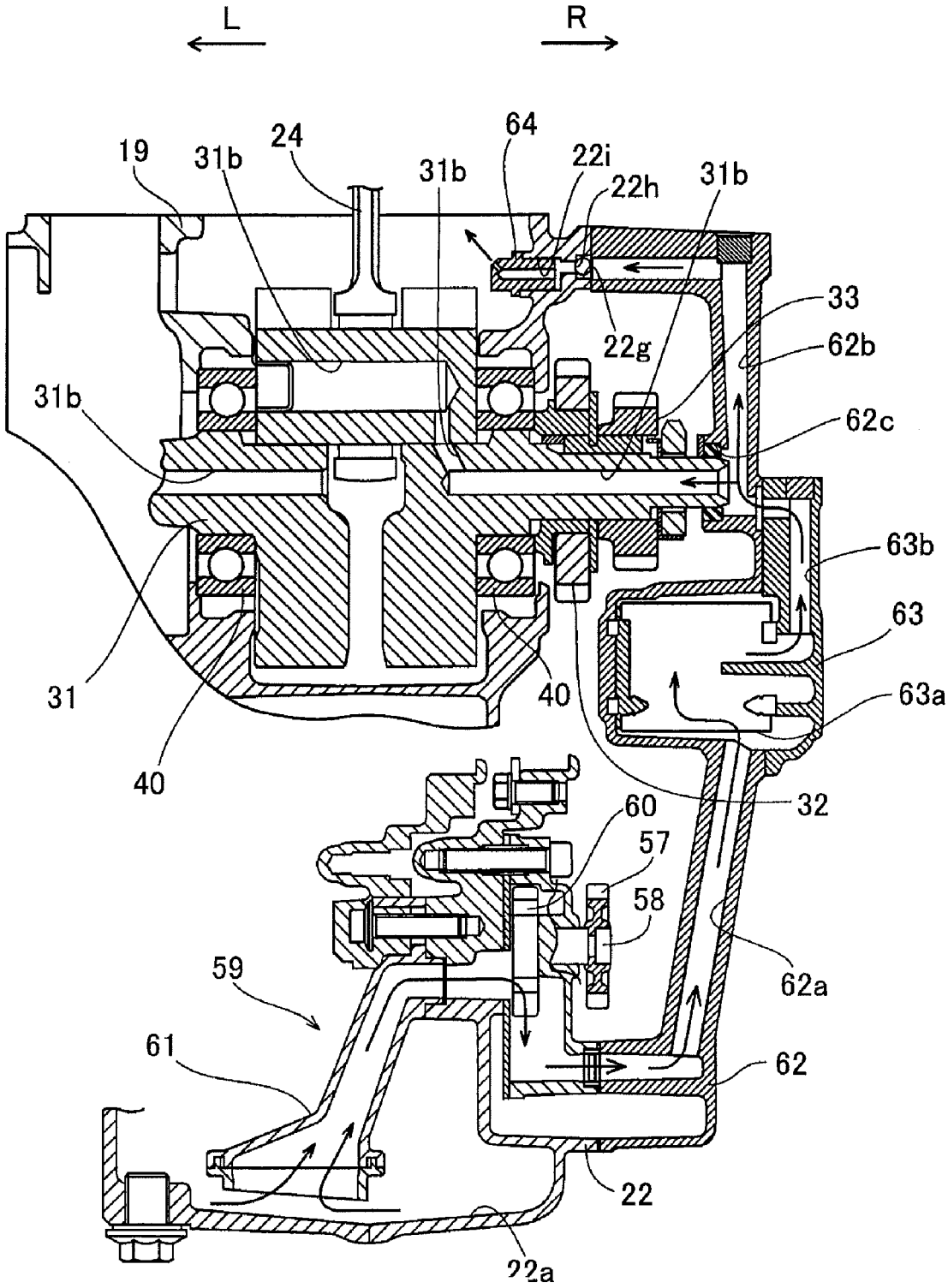
FIG. 5 is a cross sectional view showing an oil path formed in the vicinity of a crankcase of the engine provided in the motorcycle in accordance with the embodiment shown in FIG. 1.

As shown in FIGS. 3 and 5, the crankshaft 31 is formed with an oil passage 31*b* extending in the axial direction of the crankshaft 31. The oil passage 31*b* is configured to allow oil fed from an oil pump part 59 (to be discussed later) to flow therethrough. The oil flowing through the oil passage 31*b* has a function of lubricating the crankshaft 31, the bearings 40, and so on.

In accordance with an embodiment, as shown in FIG. 4, the crankcase 22 is provided with an oil guide 22*d* formed to extend along the outer periphery of the crankshaft 31 and disposed below the crankshaft 31. The oil guide 22*d* has a function of guiding oil having flowed out from the crankshaft 31 and lubricated the crankshaft 31, the bearings 40 (see FIG. 3), and so on to the oil pan 22*a* at the bottom of the crankcase 22. The oil guide 22*d* is formed with a discharge port 22*e* for guiding the oil to the opening 22*c* of the oil pan 22*a*. The discharge port 22*e* is formed to extend along the rotational direction of the crankshaft 31 (e.g., an "A" direction as shown in FIG. 4). In other words, the discharge port 22*e* is formed so as to allow oil having flowed out along with the rotation of the crankshaft 31 to smoothly move toward the opening 22*c* of the oil pan 22*a*.

As shown in FIG. 3, a generation device 41 is attached to the other end of the crankshaft 31 (in the direction of the arrow L). The generation device 41 is configured to generate electricity along with the rotation of the crankshaft 31. A starter gear 42 is fixed to the crankshaft 31 adjacent to the generation device 41 in the direction of the arrow R. The starter gear 42 is connected to a starter motor 43 (see FIG. 2) via a plurality of intermediate gears (not shown). A gear 31*a* is provided on the crankshaft 31 at a side of the starter gear 42 in the direction of the arrow R. The cam chain 30 is meshed with the gear 31*a*. A restriction part 22*f* is integrally formed with the crankcase 22 at a side of the starter gear 42 in the direction of the arrow R. The restriction part 22*f* restricts movement of the starter gear 42 along the crankshaft 31 in the direction of the arrow R.

As shown in FIG. 2, the balancer gear 35 is configured to be meshed with the first crank gear 32. The balancer gear 35 is fixed to the balancer shaft 34, and configured in accordance with an embodiment such that the outside diameter of the balancer gear 35 is equal to that of the first crank gear 32. A balancer 35*a*, made of steel for example, is attached to the balancer gear 35. The balancer 35*a* has an arcuate shape, and is fixed to a flat part of the balancer gear 35 by three screw members 70. The balancer 35*a* is attached to the balancer gear 35 so as to be positioned at the lower part of the flat part of the balancer gear 35 when the piston 23 is positioned at the top dead center. Since the balancer gear 35 rotates a half turn as the first crank gear 32 rotates a half turn, the balancer 35*a* is moved to be positioned at the upper part of the flat part of the balancer gear 35 when the piston 23 is positioned at the bottom dead center.

The driven gear 37 is meshed with the second crank gear 33. The driven gear 37 is configured to have a larger diameter than that of the second crank gear 33. That is, the driven gear 37 is configured to rotate at a speed reduced from the rotational speed of the second crank gear 33. The driving force transmitted to the driven gear 37 is transmitted to the main shaft 36 via the clutch mechanism 39. In other words, the clutch mechanism 39 is configured to be able to intermittently transmit the driving force transmitted to the driven gear 37 to the main shaft 36. As shown in FIG. 3, the main shaft 36 is rotatably supported by a pair of bearings 43 mounted in the crankcase 22. The driving force transmitted to the main shaft 36 is transmitted to a drive shaft 45 via a transmission mechanism 44. The drive shaft 45 is rotatably supported by a pair of bearings 46 mounted in the crankcase 22. A drive sprocket 47 is attached to an end of the drive shaft 45 in the direction of the arrow L. This allows the driving force transmitted to the drive shaft 45 to be transmitted to the rear wheel 12 (see FIG. 1) via the drive chain 14.

A sprocket cover 48 is provided at a side of the drive sprocket 47 in the direction of the arrow L. The sprocket cover 48 has a function of restraining mud or the like splashed from the road surface from being caught between the drive sprocket 47 and the drive chain 14. A chain guide 49 is provided near the outer periphery of the drive sprocket 47. The chain guide 49 has a function of restraining the drive chain 14 from derailing from the drive sprocket 47. The chain guide 49 and the sprocket cover 48 are together fastened to an outer side of the crankcase 22 (in the direction of the arrow L) by a screw member 71. In other words, the chain guide 49 is fixed as interposed between the sprocket cover 48 and the outer side of the crankcase 22 (in the direction of the arrow L). The chain guide 49 is configured to be directly attachable to the outer side of the crankcase 22 (in the direction of the arrow L) in the case where the sprocket cover 48 is not necessary.

Figure 6:
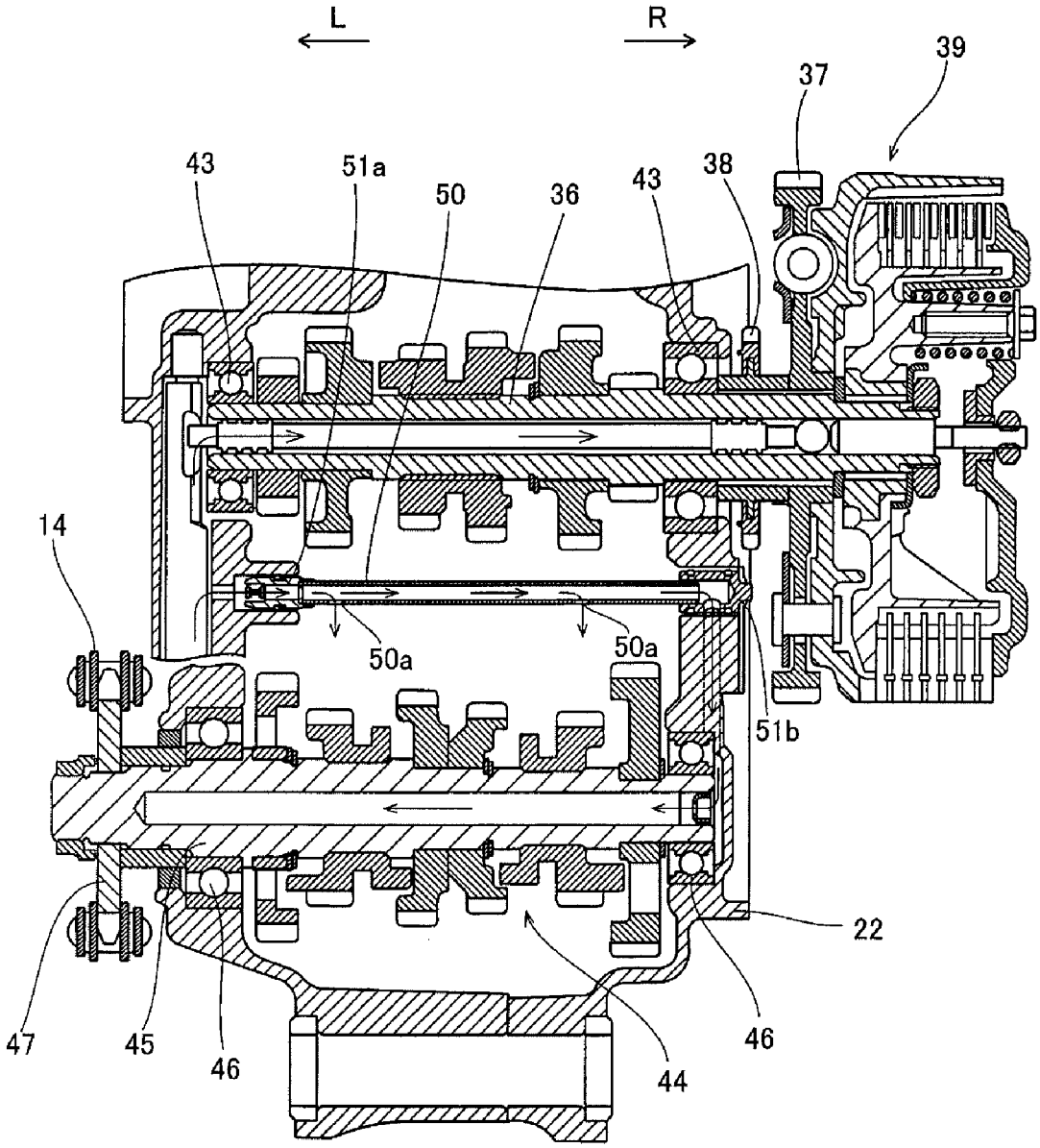
FIG. 6 is a cross sectional view showing the vicinity of a transmission mechanism of the engine provided in the motorcycle in accordance with the embodiment shown in FIG. 1.

As shown in FIGS. 4 and 6, a delivery pipe 50 having a diameter of about 5 mm is provided above the main shaft 36 and the drive shaft 45, and disposed to extend along the main shaft 36 and the drive shaft 45. As shown in FIG. 6, the delivery pipe 50 is configured to allow oil to flow through the inside thereof. The delivery pipe 50 is formed with bores 50*a* (see FIG. 6) for supplying oil flowing through the inside of the delivery pipe 50 to the transmission mechanism 44. The bores 50*a* are formed to have a bore diameter of about 0.8 mm so that oil flowing through the inside of the delivery pipe 50 is spouted toward the transmission mechanism 44. As shown in FIG. 6, a part of the delivery pipe 50 upstream with respect to the oil flow (in the direction of the arrow L) is disposed in a part of the inside of the crankcase 22 in the direction of the arrow L. A connecting member 51*a* for connecting the delivery pipe 50 and the crankcase 22 is disposed at the part of the delivery pipe 50 upstream with respect to the oil flow (in the direction of the arrow L). The connecting member 51*a* is formed with an aperture having a diameter of about 1.1 mm. A part of the delivery pipe 50 downstream with respect to the oil flow (in the direction of the arrow R) is disposed in a part of the inside of the crankcase 22 in the direction of the arrow R, and connected to a connecting member 51*b*.

Figure 7:
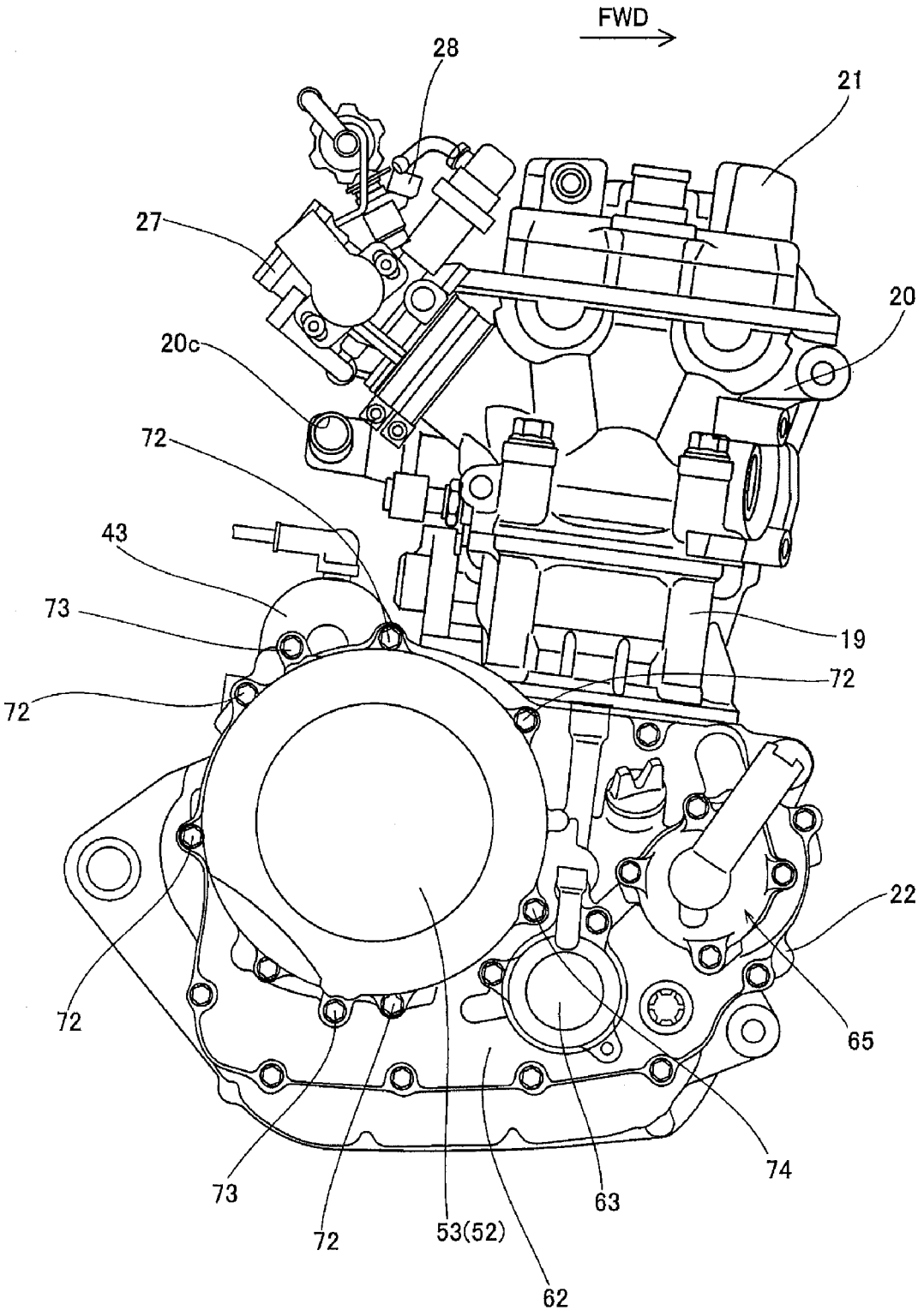
FIG. 7 is a side view of the engine provided in the motorcycle in accordance with the embodiment shown in FIG. 1.

As shown in FIG. 3, a clutch cover 52, made of metal for example, is provided at a side of the clutch mechanism 39 in the direction of the arrow R. Specifically, as shown in FIGS. 3 and 7, the clutch cover 52 is fixed to a crankcase cover 62 of the crankcase 22 to be discussed later using a plurality of screw members 72 so as to cover the clutch mechanism 39 from the direction of the arrow R. As shown in FIG. 3, a cover member 53, made of resin for example, is provided on a side of the clutch cover 52 in the direction of the arrow R. A sound absorption member 54, made of sponge for example (or other type of sound absorption material as would be understood by one skilled in the art), is sandwiched between the clutch cover 52 and the cover member 53. Specifically, as shown in FIGS. 3 and 7, the sound absorption member 54 is bonded to a surface of the cover member 53 in the direction of the arrow L (on the inner side), and the cover member 53 is fixed to clutch cover 52 using two screw members 73 so as to cover the clutch cover 52 from the direction of the arrow R. The cover member 53 and the clutch cover 52 are together fastened to the crankcase 22 using a screw member 74.

Figure 8:
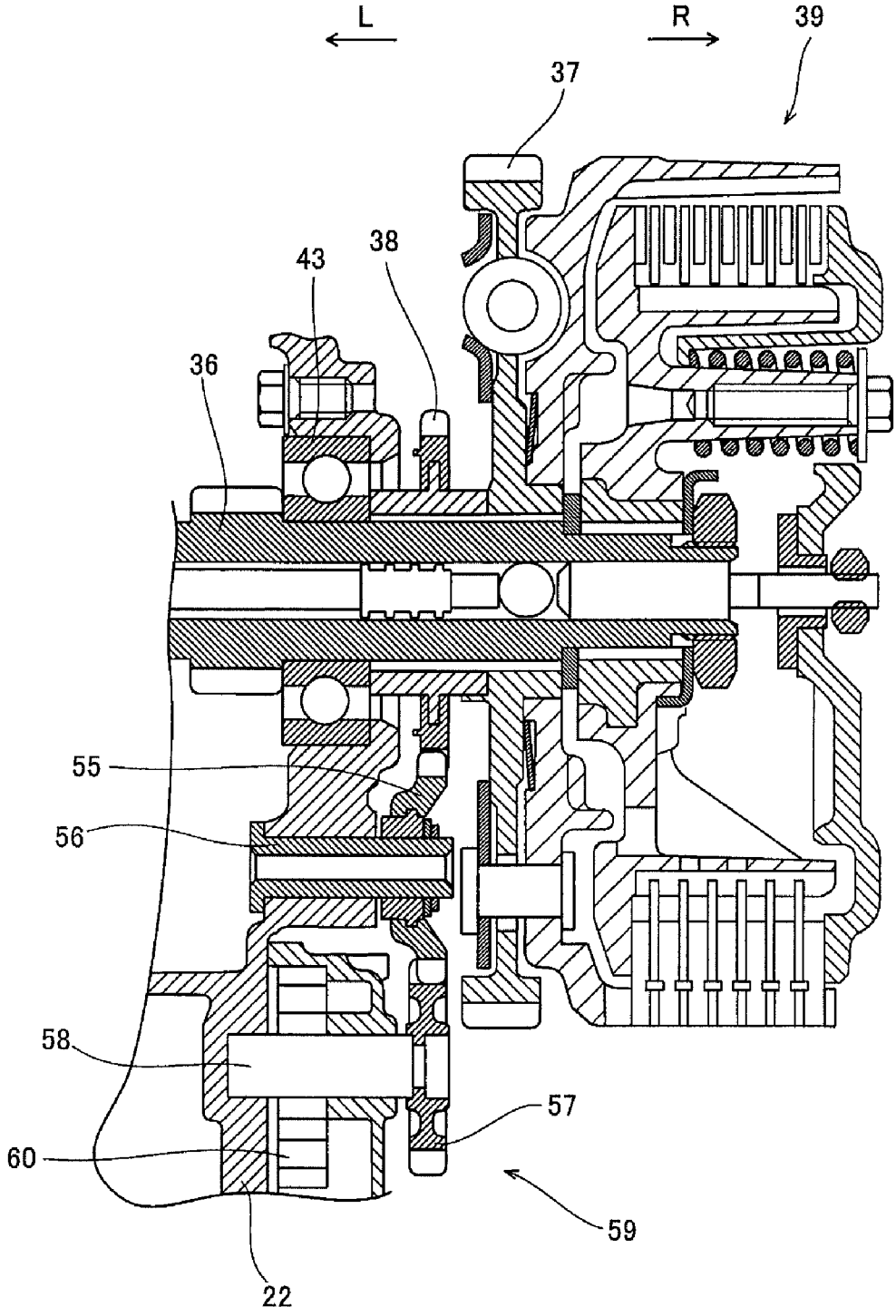
FIG. 8 is a cross sectional view taken along the line 100-100 of FIG. 2.

In accordance with an embodiment, as shown in FIGS. 2 and 8, the oil pump drive gear 38, made of resin for example, is engaged on a side of the driven gear 37 in the direction of the arrow L. The oil pump drive gear 38 is configured to rotate together with the driven gear 37. The oil pump drive gear 38 is configured such that the outside diameter of the oil pump drive gear 38 is smaller than that of the driven gear 37. Since the oil pump drive gear 38 rotates together with the driven gear 37 (see FIG. 2) which rotates at a speed reduced from the rotational speed of the second crank gear 33 (e.g., about 10,000 rpm at the maximum), the rotational speed of the oil pump drive gear 38 (e.g., about 3,300 rpm at the maximum) is lower than that of the second crank gear 33. The rotational speed of the second crank gear 33 is an example of the "second rotational speed" in accordance with an embodiment of the present invention, and the rotational speed of the oil pump drive gear 38 is an example of the "first rotational speed" in accordance with an embodiment of the present invention.

In accordance with an embodiment, an intermediate gear 55, made of resin for example, is meshed with the oil pump drive gear 38. The intermediate gear 55 is rotated as the oil pump drive gear 38 rotates. The intermediate gear 55 is disposed between the oil pump drive gear 38 and an oil pump gear 57 to be discussed later, and configured to rotate about an intermediate gear shaft 56. The intermediate gear shaft 56 is rotatably mounted in the crankcase 22. The intermediate gear 55 is disposed to overlap the driven gear 37 as viewed from the direction of the arrow L and the direction of the arrow R (as viewed from an axial end of the crankshaft 31). Specifically, the intermediate gear 55 is disposed to be covered by the driven gear 37 from the direction of the arrow R. The intermediate gear 55 is configured such that the outside diameter of the intermediate gear 55 is smaller than that of the oil pump drive gear 38. That is, the intermediate gear 55 is configured such that the rotational speed of the intermediate gear 55 (e.g., about 6,000 rpm at the maximum) is higher than that of the oil pump drive gear 38 (about 3,300 rpm at the maximum).

In accordance with an embodiment, an oil pump gear 57, made of resin for example, is meshed with the intermediate gear 55. The oil pump gear 57 is rotated as the intermediate gear 55 rotates. That is, the oil pump gear 57 is configured to be rotated via the intermediate gear 55 as the oil pump drive gear 38 rotates. The oil pump gear 57 is fixed to an oil pump gear shaft 58 for rotatably supporting the oil pump gear 57. The oil pump gear 57 is configured such that the outside diameter of the oil pump gear 57 is approximately equal to that of the intermediate gear 55, and such that the rotational speed of the oil pump gear 57 (e.g., about 6,000 rpm at the maximum) is approximately equal to that of the intermediate gear 55 (e.g., about 6,000 rpm at the maximum). That is, the oil pump gear 57 is configured such that the rotational speed of the oil pump gear 57 is higher than that of the oil pump drive gear 38. The oil pump gear 57 is an example of the "second gear" in accordance with an embodiment of the present invention, and the rotational speed of the oil pump gear 57 is an example of the "third rotational speed" in accordance with an embodiment of the present invention. The oil pump gear 57 is configured such that the rotational speed of the oil pump gear 57 (e.g., about 6,000 rpm at the maximum) is lower than that of the second crank gear 33 (e.g., about 10,000 rpm at the maximum).

In accordance with an embodiment, the oil pump gear 57 is disposed to overlap the driven gear 37 as viewed from the direction of the arrow L and the direction of the arrow R (as viewed from an axial end of the crankshaft 31). Specifically, the oil pump gear 57 is disposed such that an upper part of the oil pump gear 57 is covered by the driven gear 37 from the direction of the arrow R. As shown in FIG. 2, the oil pump gear 57 is configured to be positioned higher than the oil surface F1 of the oil reserved inside the crankcase 22. The oil pump gear shaft 58 is disposed in the crankcase 22 so as to be positioned higher than a lower end 37*a* of the driven gear 37.

As shown in FIGS. 2 and 8, the oil pump gear 57 and the oil pump gear shaft 58 constitute an oil pump part 59. As shown in FIG. 5, an oil pump rotor 60 is attached to the oil pump gear shaft 58 at the opposite side of the oil pump gear 57 (in the direction of the arrow L). The oil pump rotor 60 is rotated via the oil pump gear shaft 58 as the oil pump gear 57 is rotated. This enables the oil reserved in the oil pan 22 to be sucked and fed through the inside of the engine 15. As shown in FIGS. 4 and 5, an oil suction duct 61 is provided at the lower part of the oil pump part 59. One end (lower end) of the oil suction duct 61 is inserted into the opening 22*c* (see FIG. 4) of the oil pan 22 which reserves oil. The oil suction duct 61 has a function of filtering the oil reserved in the oil pan 22*a*.

As shown in FIGS. 5 and 7, a crankcase cover 62 is attached to an outer surface of the crankcase 22 in the direction of the arrow R. As shown in FIG. 5, the crankcase cover 62 is formed with an oil passage 62*a*. One side of the oil passage 62*a* is connected to the oil pump part 59. An oil filter unit 63 is provided at the other side of the oil passage 62*a*. As shown in FIGS. 5 and 7, the oil filter unit 63 is attached to the crankcase cover 62, and includes a filter 63*a* (see FIG. 5) and an oil passage 63*b* (see FIG. 5). As shown in FIG. 5, the filter 63*a* is disposed on the upstream side of oil flowing through. The oil passage 63*b* is disposed on the downstream side of oil flowing through, and connected to an oil passage 62*b* formed in the crankcase cover 62.

A hole 62*c* is formed at an upstream side of the oil passage 62*b* on the crankcase 22 side (in the direction of the arrow L). An end of the crankshaft 31 in the direction of the arrow R is inserted into the hole 62*c*. This allows the oil passage 31*b* of the crankshaft 31 to be connected to the oil passage 62*b*, enabling oil to flow into the oil passage 31*b* of the crankshaft 31. The downstream end of the oil passage 62*b* is connected to an oil flow-in part 22*g* of the crankcase 22. The oil flow-in part 22*g* is formed with an oil passage 22*h* for allowing oil to flow through various parts inside the engine 15, and a connecting part 22*i* to which a piston cooler member 64 is connected. The piston cooler member 64 is provided to cool the piston 23 (see FIG. 2) by ejecting oil toward the piston 23.

As shown in FIG. 7, a water pump part 65 is attached to the crankcase cover 62. The water pump part 65 has a function of feeding coolant having flowed from the radiator 10 (see FIG. 1) into the water pump part 65 into the engine 15 and allowing the coolant to flow back into the radiator 10. As shown in FIG. 2, the water pump part 65 is provided with a water pump gear 66 for driving the water pump part 65. The water pump gear 66 is meshed with the second crank gear 33, and configured to rotate as the second crank gear 33 rotates. The water pump gear 66 is configured such that the outside diameter of the water pump gear 66 is larger than that of the second crank gear 33. That is, the water pump gear 66 is configured such that the rotational speed of the water pump gear 66 (e.g., about 6,000 rpm at the maximum) is reduced from that of the second crank gear 33 (e.g., about 10,000 rpm at the maximum).

The water pump gear 66 is disposed to overlap the balancer gear 35 as viewed from an axial end of the crankshaft 31. That is, the water pump gear 66 and the balancer gear 35 are disposed so as not to occupy a large space as viewed from an axial end of the crankshaft 31. The water pump gear 66 and the balancer gear 35 are provided higher than the oil pump gear 57, and disposed higher than the oil surface of oil reserved in the crankcase 22 at the height F1.

In accordance with an embodiment, the oil pump gear 57 is disposed to overlap the driven gear 37 as viewed from an axial end of the crankshaft 31 as described above, and thus can be disposed in the higher area by the amount of vertical overlap between the oil pump gear 57 and the driven gear 37. This restrains the oil pump gear 57 from being disposed in the lower area of the engine 15 as viewed from an axial end of the crankshaft 31, and it is therefore possible to restrain the oil pump gear 57 from contacting the oil reserved in the crankcase 22 and agitating the oil. As a result, it is possible to restrain a part of the rotation force of the oil pump gear 57 from being used to agitate the oil, and thus to restrain a loss of the driving force of the engine 15.

In accordance with an embodiment, the outside diameter of the oil pump drive gear 38 is configured to be smaller than that of the driven gear 37. Since the oil pump drive gear 38 which has an outside diameter smaller than that of the driven gear 37 can be used to transmit the rotational speed equal to that of the driven gear 37 to the oil pump gear 57, the outside diameter of the oil pump gear 57 can be reduced compared to the case where the oil pump gear 57 is directly meshed with the driven gear 37 to be rotated. Since this allows the lower end of the oil pump gear 57 to be disposed higher, it is possible to further restrain the oil pump gear 57 from contacting the oil reserved in the crankcase 22 and agitating the oil.

In accordance with an embodiment, the intermediate gear 55 is disposed between the oil pump drive gear 38 and the oil pump gear 57 and is to be rotated as the oil pump drive gear 38 rotates so as to rotate the oil pump gear 57. Therefore, the driving force of the oil pump drive gear 38 can be transmitted to the oil pump gear 57 via the intermediate gear 55 with the oil pump part 59 disposed at a desired position.

In accordance with an embodiment, the intermediate gear 55 is disposed to overlap the driven gear 37 as viewed from an axial end of the crankshaft 31, and thus can be disposed in the higher area by the amount of vertical overlap between the intermediate gear 55 and the driven gear 37. This restrains the intermediate gear 55 from being disposed in the lower area of the engine 15 as viewed from an axial end of the crankshaft 31, and it is therefore possible to restrain the intermediate gear 55 from contacting the oil reserved in the crankcase 22 and agitating the oil.

In accordance with an embodiment, the oil pump gear shaft 58 is disposed higher than the lower end 37*a* of the driven gear 37, and thus the oil pump gear 57 can be restrained from being disposed in the lower area of the engine 15 as viewed from an axial end of the crankshaft 31. Therefore, it is possible to further restrain the oil pump gear 57 from contacting the oil reserved in the crankcase 22 and agitating the oil.

It should be understood that the embodiments disclosed herein are construed to be illustrative in all respects rather than restrictive. The scope of the present invention is defined by the scope of the claims rather than by the description of one or more of the above embodiments, and includes all modifications falling within the scope of the claims and equivalents thereof.

For example, in accordance with an embodiment, a motorcycle is described as an example of the vehicle including an internal combustion engine. However, the present invention is not limited thereto, and may be applied to vehicles provided with an internal combustion engine other than motorcycles, such as bicycles, tricycles, and ATVs (all terrain vehicles).

In accordance with an embodiment, the intermediate gear is provided between the oil pump drive gear and the oil pump gear. However, the present invention is not limited thereto, and the oil pump drive gear and the oil pump gear may be directly meshed with each other.

In accordance with an embodiment, a part of the oil pump gear overlaps the speed reduction gear as viewed from an axial end of the crankshaft. However, the present invention is not limited thereto, and the entirety of the oil pump gear may overlap the speed reduction gear as viewed from an axial end of the crankshaft.

Embodiments described above illustrate but do not limit the invention. It should also be understood that numerous modifications and variations are possible in accordance with the principles of the present invention. Accordingly, the scope of the invention is defined only by the following claims.

What is claimed is:

1. An internal combustion engine comprising:
a crankcase including an oil pan;
a crankshaft disposed inside the crankcase;
an output gear disposed inside the crankcase to rotate about the crankshaft;
a speed reduction gear meshed with the output gear to be rotated as the output gear rotates;
a first gear coaxial with the speed reduction gear so as to rotate together with the speed reduction gear; and
a second gear to be rotated as the first gear rotates,
wherein the second gear is disposed to overlap the speed reduction gear as viewed from an axial end of the crankshaft.

2. The internal combustion engine according to claim 1, wherein an outside diameter of the first gear is configured to be smaller than that of the speed reduction gear.

3. The internal combustion engine according to claim 1,
wherein the first gear is configured such that a first rotational speed of the first gear is lower than a second rotational speed of the output gear; and
wherein the second gear is configured such that a third rotational speed of the second gear is higher than the first rotational speed of the first gear and lower than the second rotational speed of the output gear.

4. The internal combustion engine according to claim 1, further comprising an intermediate gear disposed between the first gear and the second gear to be rotated as the first gear rotates and to rotate the second gear.

5. The internal combustion engine according to claim 4, wherein the intermediate gear is disposed to overlap the speed reduction gear as viewed from an axial end of the crankshaft.

6. The internal combustion engine according to claim 4, wherein the first gear, the intermediate gear, and the second gear are each made of resin.

7. The internal combustion engine according to claim 1, wherein the second gear is disposed higher than an oil surface of oil reserved in the oil pan of the crankcase.

8. The internal combustion engine according to claim 1, further comprising:
an oil pump part,
wherein the second gear comprises an oil pump gear attached to the oil pump part; and
wherein the first gear comprises an oil pump drive gear for rotating the oil pump gear.

9. The internal combustion engine according to claim 8,
wherein the oil pump part further includes an oil pump gear shaft that rotates together with the oil pump gear; and
wherein the oil pump gear shaft is disposed higher than a lower end of the speed reduction gear.

10. The internal combustion engine according to claim 1, wherein the crankcase further includes a wall disposed above the oil pan to restrain oil reserved in the oil pan from splashing.

11. The internal combustion engine according to claim 10, wherein the wall has an opening, and wherein the wall is formed to be inclined downward toward the opening.

12. The internal combustion engine according to claim 1, wherein the crankcase further includes an oil guide disposed below the crankshaft to guide oil having flowed out from the crankshaft to the oil pan.

13. The internal combustion engine according to claim 12, wherein the oil guide has a discharge port for guiding the oil having flowed out from the crankshaft to an opening of the oil pan.

14. A vehicle comprising the internal combustion engine according to claim 1.

15. A vehicle comprising the internal combustion engine according to claim 3.

16. A vehicle comprising the internal combustion engine according to claim 5.

17. A vehicle comprising the internal combustion engine according to claim 7.

18. A vehicle comprising the internal combustion engine according to claim 9.

19. A vehicle comprising the internal combustion engine according to claim 11.

20. A vehicle comprising the internal combustion engine according to claim 13.

* * * * *